US005636415A

United States Patent [19]

James

[11] Patent Number: 5,636,415

[45] Date of Patent: Jun. 10, 1997

[54] ZIPPER WITH ANTI-DERAILING RIBS

[75] Inventor: Peter A. R. James, Woodley, England

[73] Assignee: Illinois Tool Works Inc., Glenview, Ill.

[21] Appl. No.: 522,696

[22] Filed: Sep. 1, 1995

[51] Int. Cl.[6] ..... A44B 19/16

[52] U.S. Cl. ..... 24/399; 24/427

[58] Field of Search ..... 24/400, 399, 427, 24/415

[56] References Cited

U.S. PATENT DOCUMENTS

| | | | |
|---|---|---|---|
| 2,581,604 | 1/1952 | Roehrl | 24/400 |
| 2,606,351 | 8/1952 | Wende | 24/400 |
| 2,613,421 | 10/1952 | Madsen | 24/399 |
| 2,652,611 | 9/1953 | Jaster | 24/399 |
| 2,867,879 | 1/1959 | Urban et al. | 24/427 X |
| 3,266,112 | 8/1966 | Heckman | 24/400 |
| 3,925,857 | 12/1975 | Kihara | 24/427 |
| 5,189,764 | 3/1993 | Herrington et al. | 24/399 X |
| 5,442,838 | 8/1995 | Richardson et al. | 24/399 X |

FOREIGN PATENT DOCUMENTS

| | | | |
|---|---|---|---|
| 257510 | 10/1967 | Austria | 24/400 |
| 564261 | 10/1993 | European Pat. Off. | 24/400 |
| 643988 | 10/1950 | United Kingdom | 24/400 |

*Primary Examiner*—James R. Brittain

*Attorney, Agent, or Firm*—Kane, Dalsimer, Sullivan, Kurucz, Levy, Eisele and Richard, LLP

[57] ABSTRACT

A resilient fastener or zipper, which may be incorporated as part of a bag, pouch, wrapper or liner, or which may be used as a protective garment closure, includes a pair of flexible closure strips and at least one zipper slider. The strips include interlocking ribs and channels of complementary cross-sectional shape which lock together in an interference fit. The ribs have enlarged heads, and, complementarily, the channels have enlarged bottoms. The strips also include webs to which sheet material or the like may be attached and, between the webs and the interlocking ribs and channels, an anti-derailing rib. The latter ensures that the zipper slider remains on track and does not derail from the interlocking ribs and channels when the slider is moved therealong to open or to close the zipper.

14 Claims, 4 Drawing Sheets

ZIPPER WITH ANTI-DERAILING RIBS

BACKGROUND OF THE INVENTION

1. Field of the Invention

The present invention relates to improvements in resilient fasteners that provide flexible closures for a variety of different uses, such as on bags, pouches, wrappers, liners and protective garments. More specifically, the present invention relates to a new and improved resilient fastener having a zipper slider or sliders, wherein the closure strips of the resilient fastener include anti-derailing ribs which prevent the zipper slider or sliders from derailing from the closure strips during the opening or closing of the fastener.

2. Description of the Prior Art

Resilient fasteners, including those having zipper sliders, are well-known in the art. Generally, fasteners of this variety include a pair of flexible closure strips, each extruded from a polymeric resin material in continuous lengths and having an interlocking rib and groove structure. Such structures on each of the pair of flexible closure strips may be identical to one another, locking together in an interference fit. Alternatively, one of the pair of flexible closure strips may have a male interlocking member, while the other of the pair may have a female interlocking member into which the male interlocking member may be snapped in an interference fit.

Resilient fasteners of either of these two of the flexible closur strips, joining them to one sliders, which track along the interlocking structures varieties may be opened and closed with zipper another when pulled in one direction, and separating them when being pulled in the opposite direction.

The derailing of the zipper sliders from the interlocking structures of the flexible closure strips, occasioned most often by an overly energetic pulling action, is a significant problem of the prior art in the present subject area. The present invention provides a solution to this problem.

SUMMARY OF THE INVENTION

Accordingly, the present invention is a resilient fastener or zipper comprising a pair of flexible closure strips each having both a web portion, to which sheet material or the like may be attached, and an interlocking portion. Between the web portion and the interlocking portion on each strip is an anti-derailing rib which prevents a zipper slider, provided for opening and closing the zipper, from becoming untracked or derailed from the interlocking portions under energetic or rough operating conditions. The anti-derailing ribs may have a spade-shaped cross section. The flexible closure strips are extruded from a polymeric resin material.

The present invention will now be described in more complete detail with frequent reference being made to the drawing figures identified below.

DETAILED DESCRIPTION OF THE PREFERRED EMBODIMENT

Figure 1:
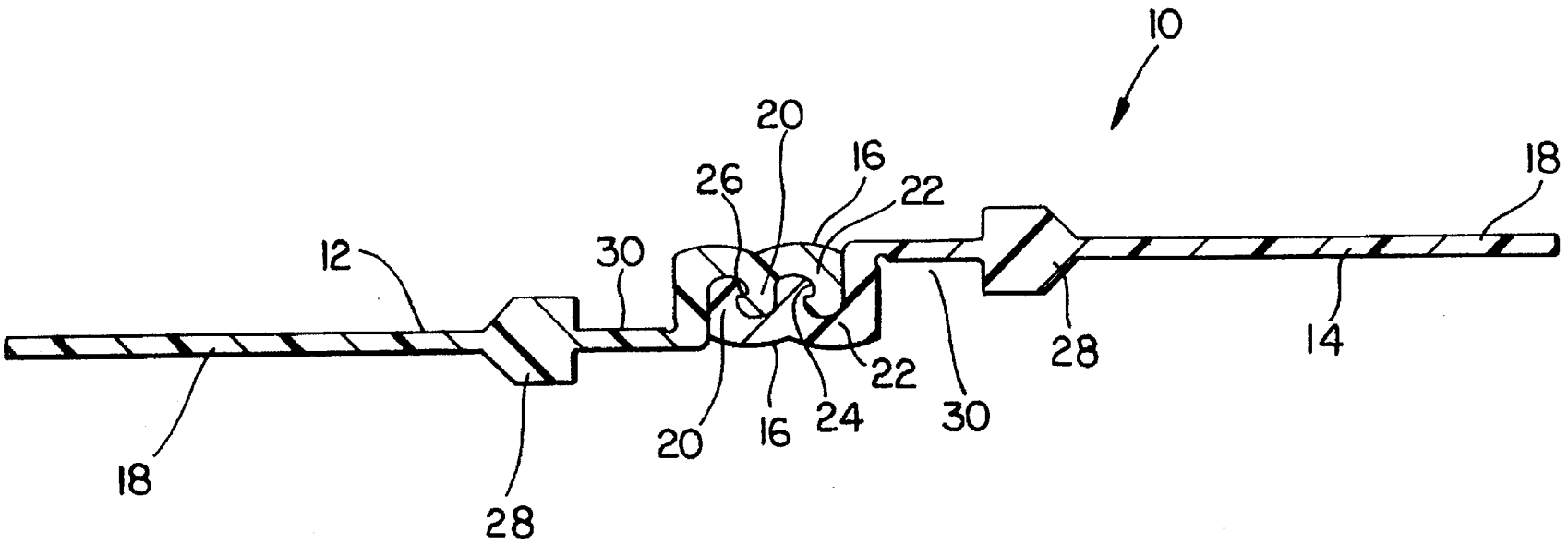
FIG. 1 is a cross section of the present resilient fastener or zipper.

In FIG. 1, a pair of flexible closure strips, joined to one another, of the present resilient fastener or zipper is shown in cross section. The zipper 10 comprises a first flexible closure strip 12 and a second flexible closure strip 14 which, as will be noted, are identical to one another, so that elements of one, described and labelled in the paragraphs to follow, may be described in identical terms, and are identically labelled in the figures.

The flexible closure strips 12, 14 each have an interlocking portion 16 and a web portion 18. The interlocking portions 16 have solid form-retaining longitudinal ribs 20 and longitudinal channels 22. The ribs 20 have an undercut interlocking hook 24 on one side thereof forming an enlarged head, while the channels 22 have an undercut interlocking groove 26 forming an enlarged bottom. The channels 22 are, in fact, generally complementary to the ribs 20, so that the flexible closure strips may lock together, as shown in FIG. 1, in an interference fit by the engagement of hooks 24 with grooves 26.

The web portions 18 are provided to attach sheet material, or the like, to each of the flexible closure strips 12, 14. Between the web portion 18 and interlocking portion 16 on each strip 12, 14 is an anti-derailing rib 28, which may, as shown in FIG. 1, be spade-shaped in cross section. The anti-derailing rib 28 is somewhat separated from the interlocking portion 16 to provide a track 30 on each flexible closure strip 12, 14. As will be shown below, the tracks 30 guide the zipper slider or sliders as they are being pulled along strips 12, 14, being maintained thereon by anti-derailing ribs 28.

Figure 2:
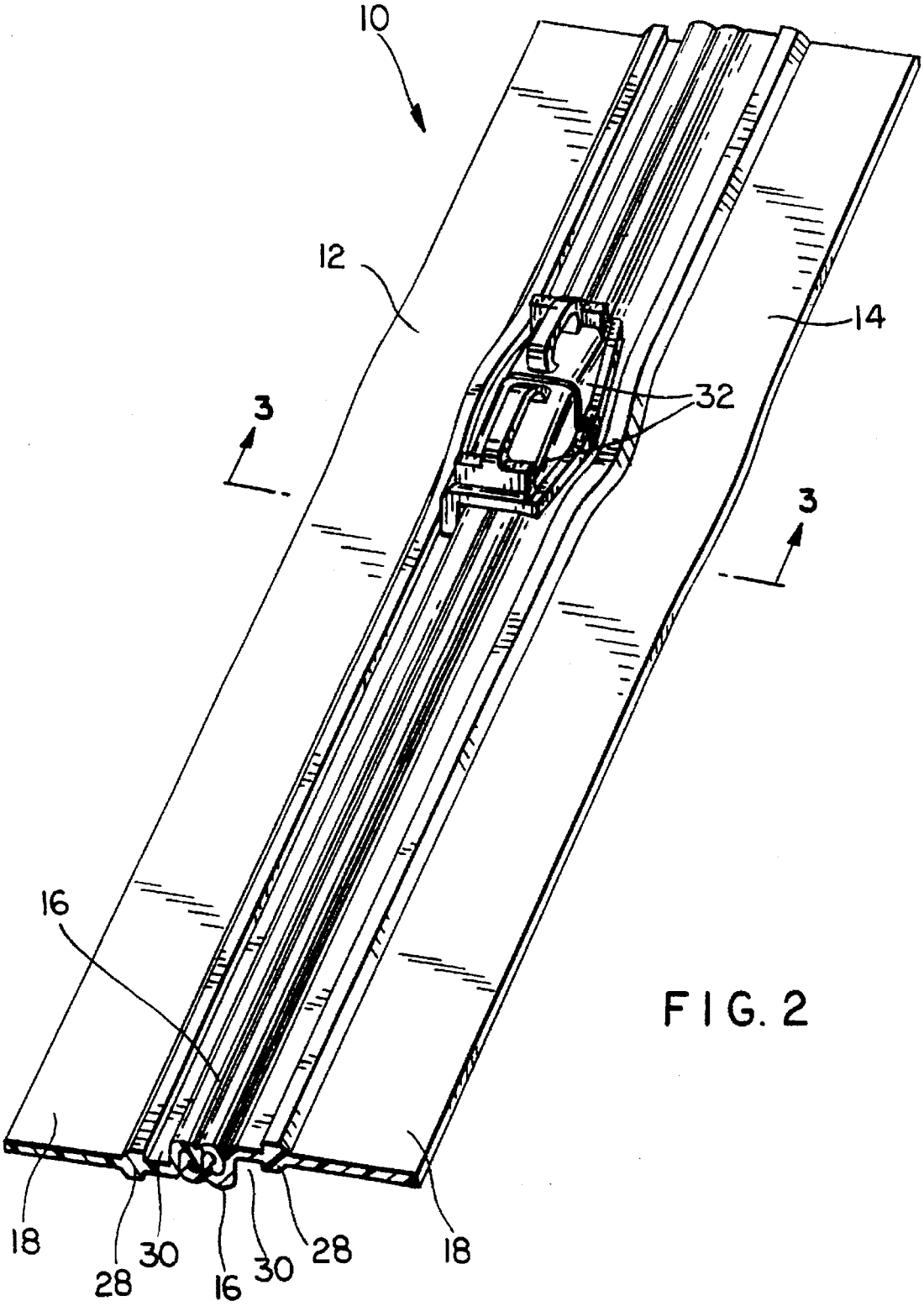
FIG. 2 is a perspective view thereof.

FIG. 2 is a perspective view of the zipper 10 of the present invention comprising first and second flexible closure strips 12, 14 and at least one zipper slider 32. Two zipper sliders 32 disposed in back-to-back fashion may be provided as shown in FIG. 2 such that, when moved in a common direction along the flexible closure strips 12, 14, one of the sliders 32 separates the interlocking portions 16 while the other joins them.

Figure 3:
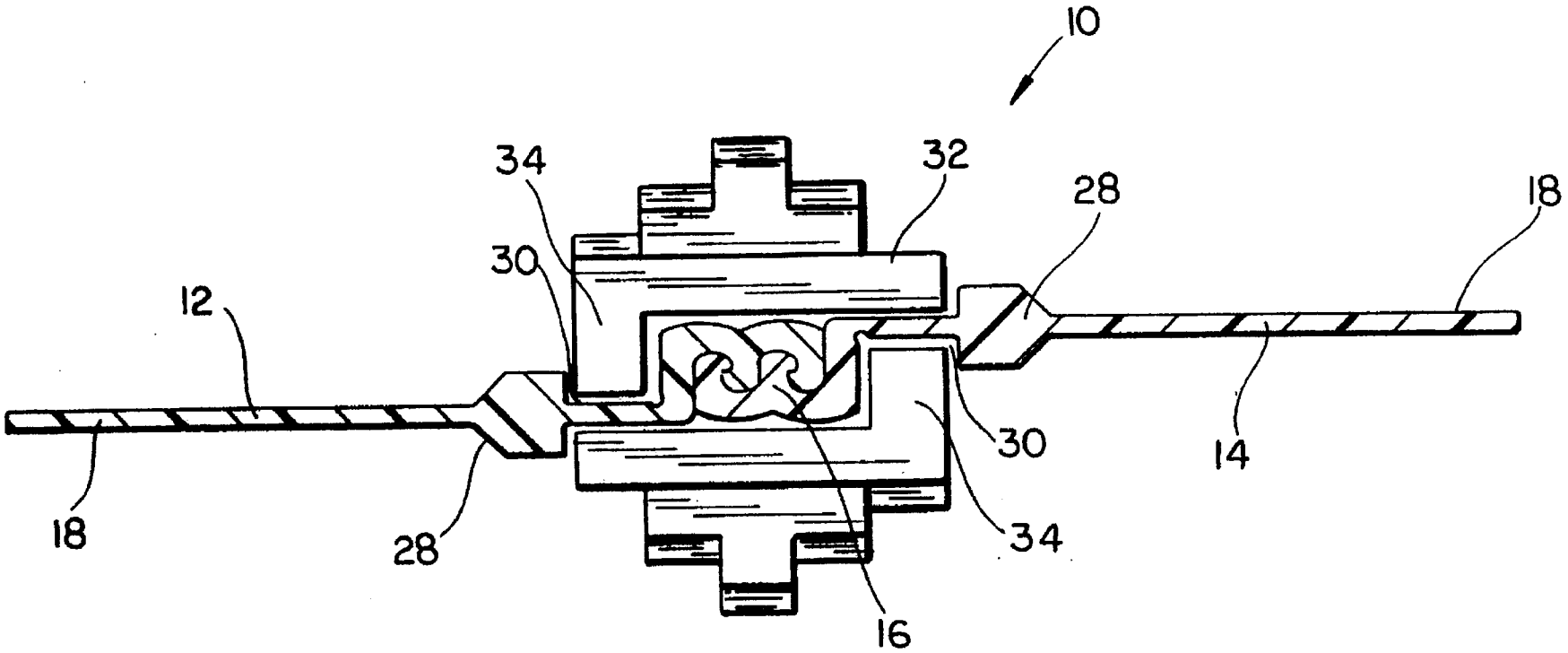
FIG. 3 is a cross section taken as indicated by line 3-3' in FIG. 2.

FIG. 3 is a cross-section taken as indicated by line 3-3' in FIG. 2 and illustrating the manner in which anti-derailing ribs 28 carry out their intended function. Zipper slider 32 is prevented from moving laterally or transversely with respect to interlocking portion 16 of flexible closure strips 12, 14 by the anti-derailing ribs 28 which abut against the lateral edges thereof. A portion 34 of the slider 32 rides within each of the tracks 30 separating interlocking portions 16 from anti-derailing ribs 28 on flexible closure strips 12, 14.

Figure 4:
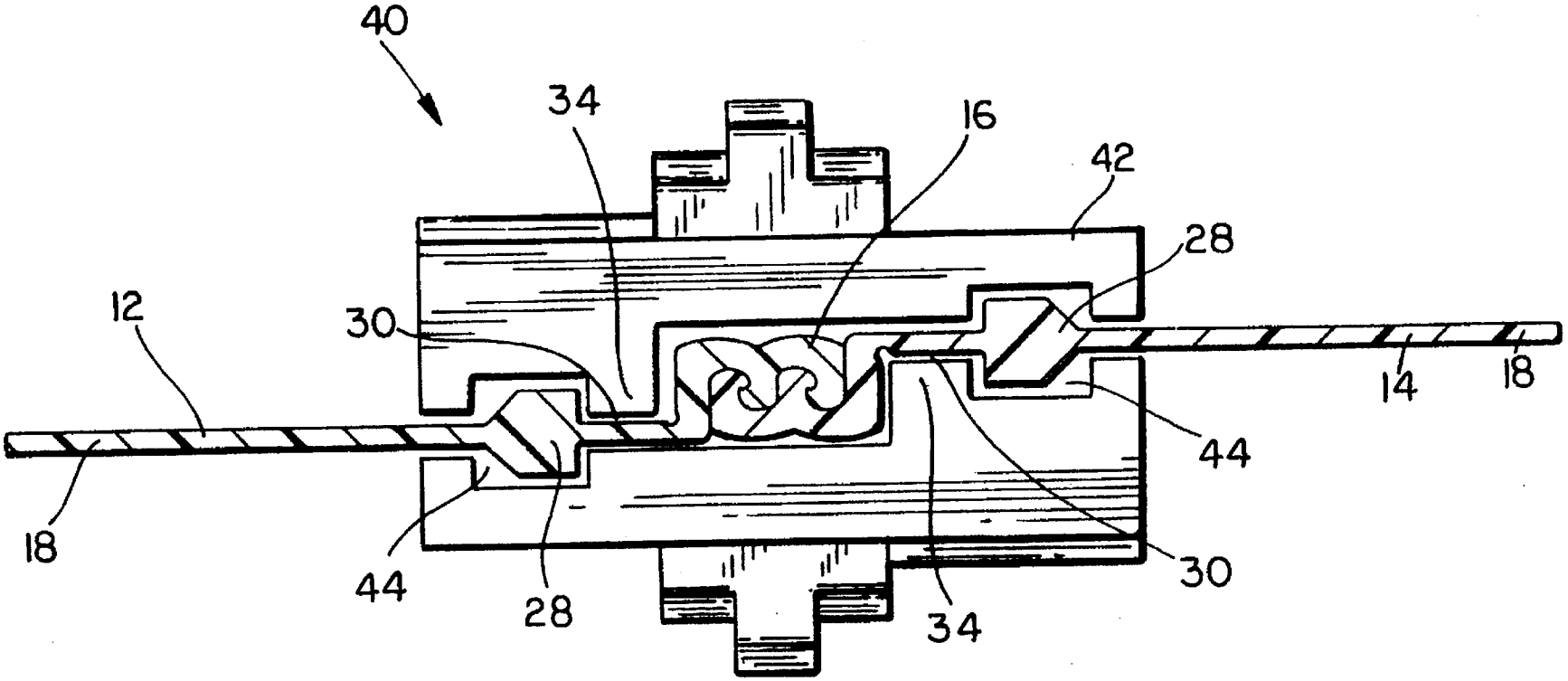
FIG. 4 is a cross section, analogous to that provided an FIG. 3, of an alternate embodiment of the present invention.

FIG. 4 is a cross section, analogous to that provided in FIG. 3 of an alternate embodiment of the present invention, zipper 40, wherein the anti-derailing ribs 28 act as an internal guide within zipper slider 42, which includes passages 44 for the ribs 28. The combined effect of portions 34 riding within tracks 30 and ribs 28 passing through passages 44 as the slider 42 is moved along flexible closure strips 12, 14 ensures against the slider 42 derailing therefrom.

The flexible closure strips 12, 14 of the resilient fasteners or zippers 10, 40 of the present invention may be extruded from any polymeric material having a hardness in the range from 60 to 95 durometer. Suitable materials are low to medium density polyethylene, polypropylene, polyurethane, polyester, polyvinyl chloride as well as any of a number of the other commercially applicable thermoplastic elastomers and thermoplastic rubbers. The zipper sliders 32, 42 may be injection molded from any of the appropriate polymeric resin materials commonly used to mold plastic parts, such as polystyrene.

Modifications to the above would be obvious to those of ordinary skill in the art, yet would not bring the invention so modified beyond the scope of the appended claims.

What is claimed is:

1. A zipper comprising:

a first flexible closure strip and a second flexible closure strip, each flexible closure strip having a web portion, said web portions extending in opposite direction, an interlocking portion, an anti-derailing rib between said web portion and said interlocking portion and a guide channel for a zipper slider between said anti-derailing rib and said interlocking portion, said first and second flexible closure strips being extruded from a polymeric resin material, and said interlocking portions of said first and second flexible closure strips being interlockable with one another in a direction perpendicular to the web portions in an interference fit.

2. A zipper as claimed in claim 1 wherein said anti-derailing rib has a spade-shaped cross section.

3. A zipper as claimed in claim 1 wherein said polymeric resin material has a hardness in the range of from 60 to 95 durometer.

4. A zipper as claimed in claim 1 wherein said polymeric resin material is selected from a group consisting of low to medium density polyethylene, polypropylene, polyurethane, polyester, polyvinyl chloride, thermoplastic elastomers and thermoplastic rubbers.

5. A zipper as claimed in claim 1 wherein said interlocking portion of said first flexible closure strip is a male interlocking member and said interlocking portion of said second flexible closure strip is a female interlocking member.

6. A zipper as claimed in claim 1 wherein said interlocking portion of said first flexible closure strip includes at least one rib and at least one channel, and said interlocking portion of said second flexible closure strip includes at least one rib and at least one channel which interlock with those of said first flexible closure strip in an interference fit.

7. A zipper as claimed in claim 6 wherein said at least one rib of said interlocking portion of each of said first and second flexible closure strips has an undercut interlocking hook along a side thereof to form an enlarged head, and wherein said at least one channel of said interlocking portion of each of said first and second flexible closure strips has an undercut interlocking groove along a side thereof to form an enlarged bottom to provide said interference fit.

8. A zipper as claimed in claim 1 wherein said anti-derailing rib is separated from said interlocking portion on each of said first and second flexible closure strips providing a track therebetween.

9. A zipper as claimed in claim 1 further comprising at least one zipper slider for separating and for joining said interlocking portions of said first and second flexible closure strips, said at least one zipper slider being between said anti-derailing ribs of said first and second flexible closure strips.

10. A zipper as claimed in claim 9 wherein said zipper slider is injection molded from a polymeric resin material.

11. A zipper as claimed in claim 10 wherein said polymeric resin material is polystyrene.

12. A zipper as claimed in claim 1 further comprising at least one zipper slider for separating and for joining said interlocking portions of said first and second flexible closure strips, said at least one zipper slider having a passage for said anti-derailing ribs of said first and second flexible closure strips.

13. A zipper as claimed in claim 12 wherein said zipper slider is injection molded from a polymeric resin material.

14. A zipper as claimed in claim 13 wherein said polymeric resin material is polystyrene.

* * * * *